US007255591B2

(12) United States Patent
Schreier

(10) Patent No.: US 7,255,591 B2
(45) Date of Patent: Aug. 14, 2007

(54) ARRANGEMENT OF AN ELEMENT IN A CIRCULAR CONNECTOR

(75) Inventor: Stephan Schreier, Rahden (DE)

(73) Assignee: Harting Electric GmbH & Co. KG (DE)

( * ) Notice: Subject to any disclaimer, the term of this patent is extended or adjusted under 35 U.S.C. 154(b) by 0 days.

(21) Appl. No.: 10/973,880

(22) Filed: Oct. 26, 2004

(65) Prior Publication Data

US 2005/0118870 A1 Jun. 2, 2005

(30) Foreign Application Priority Data

Dec. 2, 2003 (DE) ..... 203 18 593 U

(51) Int. Cl.
*H01R 11/20* (2006.01)

(52) U.S. Cl. ..... 439/412

(58) Field of Classification Search ..... 439/412, 439/417, 425, 427

See application file for complete search history.

(56) References Cited

U.S. PATENT DOCUMENTS

| | | | | |
|---|---|---|---|---|
| 2,880,403 A | | 3/1959 | Maxwell | 339/14 |
| 4,508,401 A | | 4/1985 | Casciotti et al. | 339/14 |
| 5,989,056 A | * | 11/1999 | Lange et al. | 439/412 |
| 6,203,360 B1 | * | 3/2001 | Harting et al. | 439/412 |
| 6,551,144 B2 | * | 4/2003 | Wellmann et al. | 439/689 |

FOREIGN PATENT DOCUMENTS

| | | |
|---|---|---|
| DE | 39 12 189 | 4/1989 |
| DE | 41 37 355 | 11/1991 |
| DE | 197 27 453 | 6/1997 |
| EP | 0 475 415 | 9/1991 |

* cited by examiner

*Primary Examiner*—Tulsidas C. Patel
*Assistant Examiner*—Phuongchi Nguyen
(74) *Attorney, Agent, or Firm*—Hayes Soloway P.C.

(57) ABSTRACT

To transmit the shielding potential of an electric cable that is connected to a circular connector and surrounded by a braided shield to a mating connector, a circular connector includes a shield transfer element comprising an insulation displacement connector, a transfer contact and a spring bow in the connector housing of the circuit connector. The spring bow contacts the electrically conductive screw cap arranged on the outside of the connector housing through an opening provided in the connector housing while the transfer contact contacts a neutral wire of the circular connector in the center of the circular connector. The braided shield is connected to the shield transfer element by the insulation displacement connector.

6 Claims, 3 Drawing Sheets

ARRANGEMENT OF AN ELEMENT IN A CIRCULAR CONNECTOR

TECHNICAL FIELD

The invention pertains to an arrangement of an element in a circular connector with a connector housing and contact elements held therein, a cable connection side and a plug side in order to transmit the shielding potential of an electric cable that is connected to the circular connector and surrounded by a braided shield to a mating connector.

BACKGROUND OF THE INVENTION

An arrangement of this type is required in a circular connector in order to ensure that the shielding potential of shielded cables can be reliably transmitted from a plug to a correspondingly prepared mating connector.

DE 41 37 355 C2 discloses a circular connector for shielded cables, in which the housing is connected to the shield of the cable in an electrically conductive fashion, wherein an electrically conductive elastomer part that is realized in the form of a tube and held in the housing in an axially compressed fashion ensures the connection between the housing and the shield.

DE 197 27 453 A1 discloses a circular connector for a shielded cable that comprises an inner housing and an outer housing, as well as an end cap that can be screwed on. In addition, strain relief means are provided in this case. A crown spring is utilized for contacting the shield of a shielded cable.

BRIEF SUMMARY OF THE INVENTION

The invention is based on the objective of developing a known circular connector of the initially described type in such a way that the shielding potential of the shield of an electric signal transmission cable is transmitted to a correspondingly equipped mating connector within the circular connector.

This objective is attained in that a shield transfer element comprising an insulation displacement connector, a transfer contact and a spring bow is arranged in the connector housing.

The main advantage attained with the invention can be seen, in particular, in that the arrangement according to the invention for transmitting the shielding potential of a shielded cable in a circular connector can be realized in an already known plug connector system without requiring significant modifications. In this case, insulation displacement connectors are provided within the circular connector in order to realize the electric contacting of the individual wires of a cable.

It is advantageous that one of the regular insulation displacement connectors is replaced with a special shield transfer element that is not only provided with an insulation displacement connector, but also with a pin-shaped transfer contact as well as a spring bow.

The transfer contact is inserted into a socket contact that is centrally arranged in the plug housing and contacted with a plug contact or a socket contact of a correspondingly equipped mating connector. The spring bow of the shield transfer element is pressed against an electrically conductive screw cap of the circular connector that overlaps the plug tube through an opening in the plug tube, preferably in an elastic fashion, wherein the electrically conductive screw cap is contacted with the braided shield of the cable.

For this purpose, the braided shield is inserted into at least one slot of a sealing element that fixes the electric cable held in the sealing element and ensures an adequate seal of the circular connector with the aid of a screw cap to be screwed on the plug tube. An electrically conductive sliding ring placed onto the sealing element has the function of contacting the braided shield with the screw cap and ultimately with the shield transfer element.

Consequently, the entire circular connector features a shielding effect.

According to one variation, the braided shield is directly contacted with the insulation displacement contact of the shield transfer element.

Another variation utilizes a correspondingly equipped cable, in which a so-called sheath wire is embedded within the braided shield, wherein this sheath wire is directly contacted with the insulation displacement connector of the shield transfer element.

The invention proposes two advantageous options for transmitting the shielding potential of an electric cable to a mating connector, namely in a direct fashion via the insulation displacement connector or in an indirect fashion via the electrically conductive tube of the circular connector.

One embodiment of the invention is illustrated in the figures and described in greater detail below. The figures show:

DETAILED DESCRIPTION OF THE PREFERRED EMBODIMENT

Figure 1:
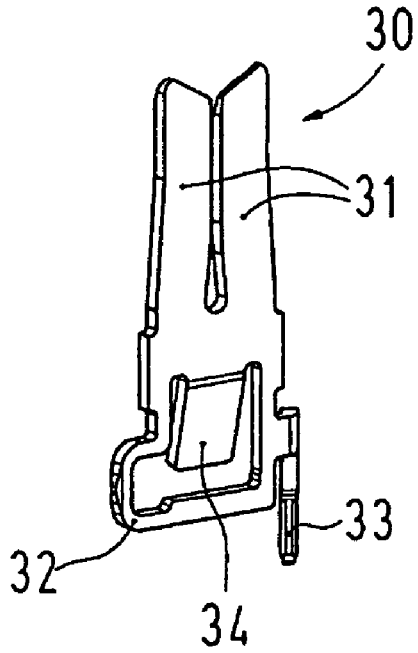
FIG. 1, a shield transfer element.

FIG. 1 shows an individual shield transfer element 30 that is manufactured in the form of a flat punching and comprises an insulation displacement connector 31, a spring bow 32, an obliquely aligned clip 34 and a transfer contact 33 in the form of a pin.

The clip 34 is punched out of the sheet metal material on three sides and obliquely protrudes from the plane of the element. The spring bow 32, in contrast, is realized in the form of an outwardly pointing loop within the plane. The pin-shaped transfer contact 33 is integrally formed onto the shield transfer element opposite of the spring bow, wherein the transfer contact is arranged on a narrow arm of the shield transfer element and slightly offset relative to the plane.

Figure 2A:
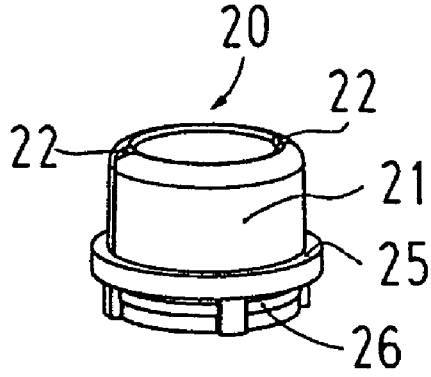
FIG. 2, a sealing element.
Figure 2C:
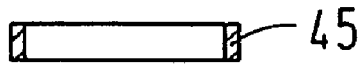
Figure 2B:
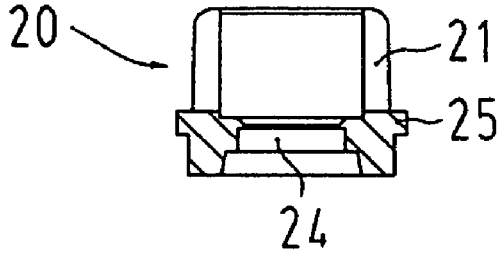

The sealing element 20 illustrated in FIGS. 2*a* and 2*b* is manufactured from a non-conductive material and realized in the form of a tube with an outer peripheral collar 25.

FIG. 2*a* shows a perspective representation and FIG. 2*b* shows a longitudinal section through the slotted region of the tube.

At least two slots 22 are oppositely arranged in tube and extend as far as the collar 25. A locking ring 26 for engaging with a splicing part 40 (see also FIG. 4) is arranged underneath the collar.

An additionally provided opening 24 for leading through the individual wires 6 of the electric cable reduces the inside diameter of the tube.

Figure 3:
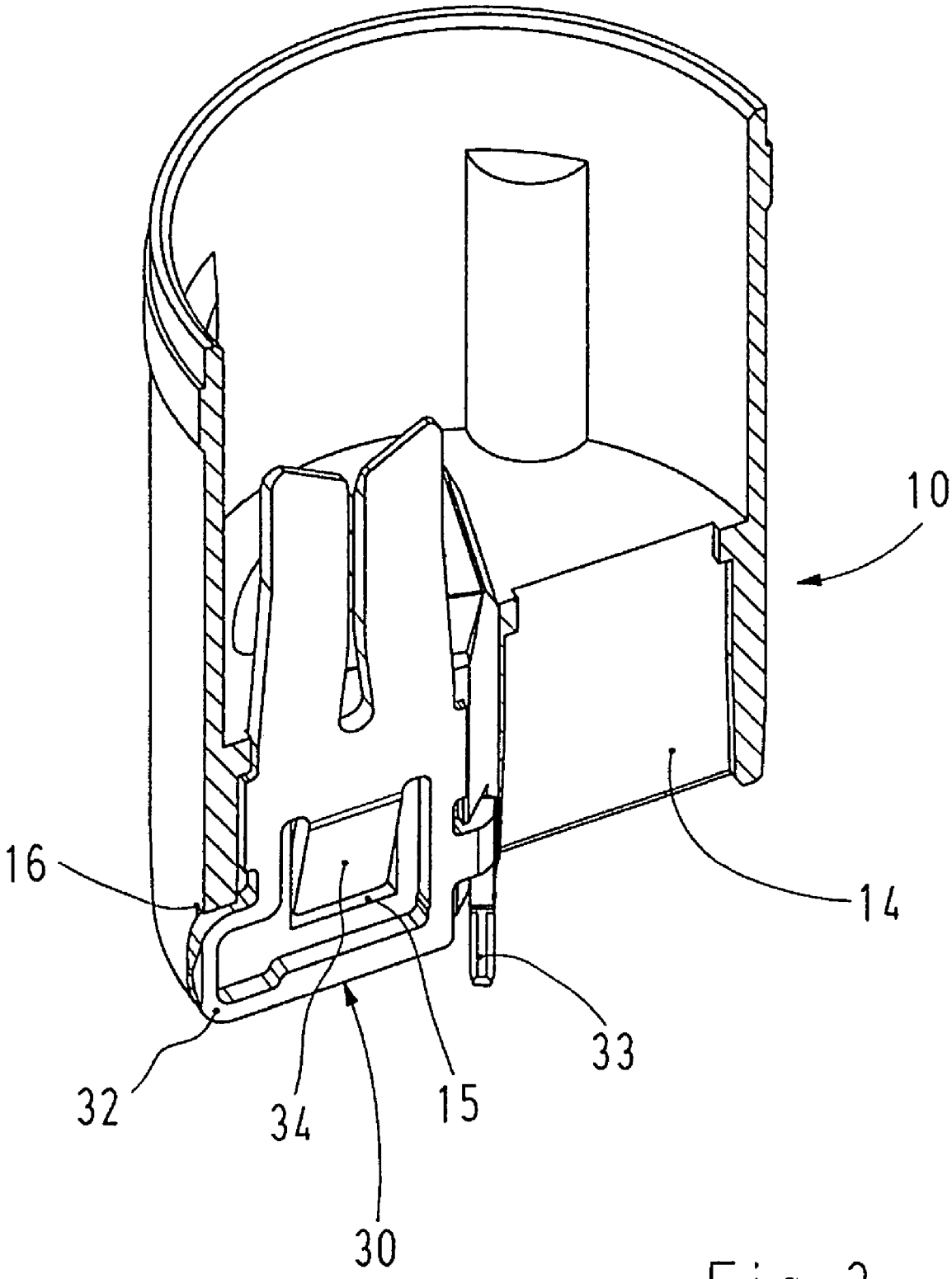
FIG. 3, a perspective representation of the shield transfer element in the sectioned connector housing, and FIG. 4, a perspective representation of a partial section through a circular connector.

FIG. 3 shows a section through the connector housing 10 of the circular connector 1, in which the shield transfer element 30 is engaged with a slot that is realized analogous to the slot 14 in the connector housing 10 illustrated further to the right.

For this purpose, the shield transfer element is inserted into the slot from the plug side of the circular connector and engaged therein by means of the clip 34, namely in a recess 15 in the connector housing 10.

The connector housing 10 is not engaged with the splicing part 40 and inserted into the plug tube 11 (see also FIG. 4) until the insulation displacement element 17 and the shield transfer element 30 are inserted.

The connector housing 10 contains a lateral opening 16, into which the spring bow 32 of the shield transfer element 30 is inserted, wherein a slight protrusion over the outer surface of the connector housing exists. This produces the contact with the electrically conductive plug tube 11 that is contacted with the electrically conductive screw cap 13 during the assembly.

Figure 4:
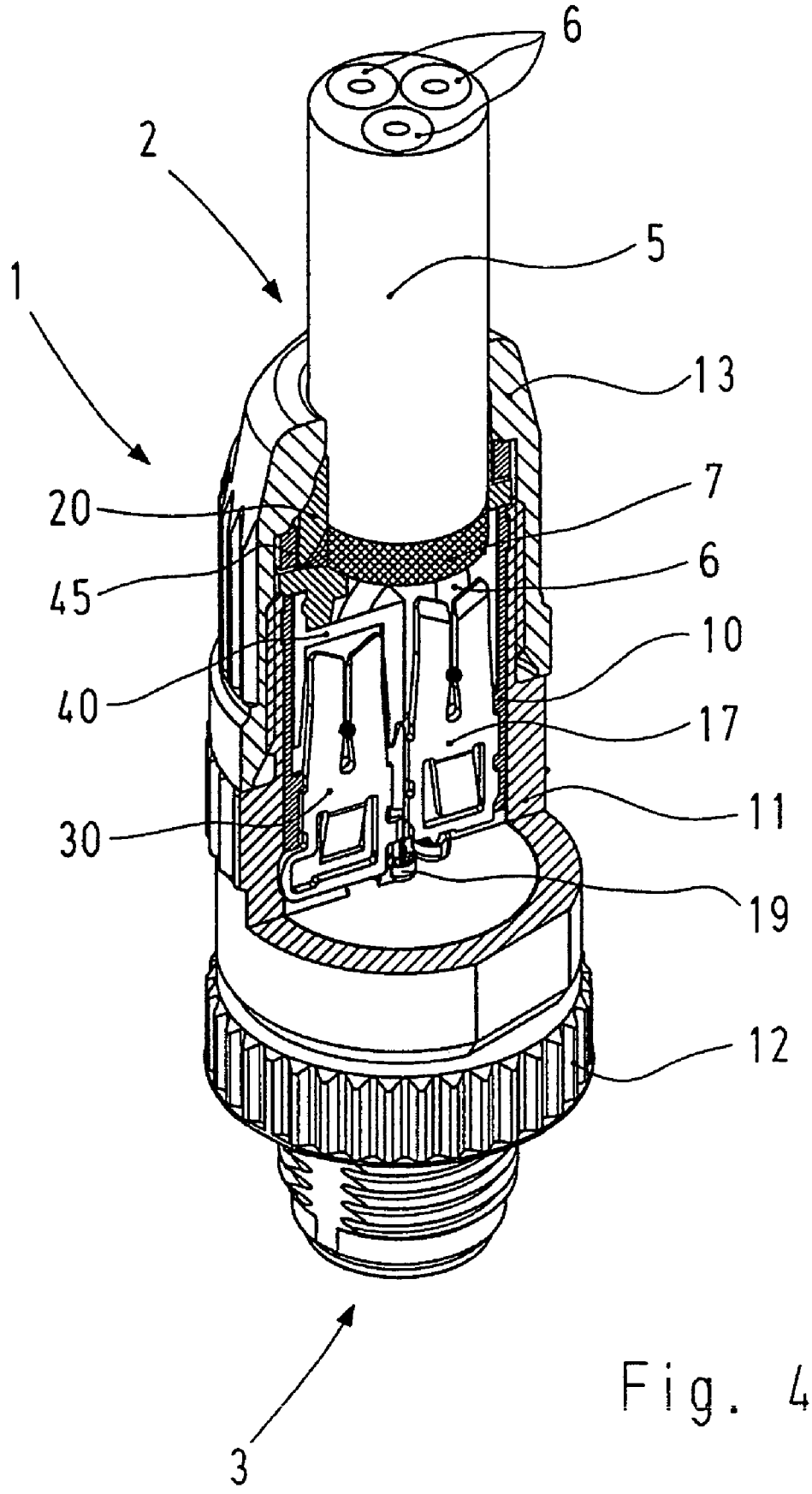

FIG. 4 shows a circular connector with an electric cable 5 in the form of a partial section such that the complete inner portion of the circular connector is visible.

The side that points downward is the plug side 3 that is provided with a thread for being screwed to a not-shown mating connector and a knurling 12.

The opposite side that points upward is the cable connection side 2 that is connected to the electric cable 5.

The axial section that extends about centrally through the circular connector consisting of the outer cover, the plug tube 11 and the screw cap 13 begins above the knurling 12 such that the shield transfer element 30 and an insulation displacement connector 17 embedded in the insulating connector housing 10 lie in front of the plane of section.

The so-called splicing part 40 is arranged above the connector housing 10, wherein the separated electric wires 6 are guided in not-shown channels in said splicing part, and wherein the insulation of the electric wires is cut open and the electric wires are contacted with the insulation displacement elements 17 that are arranged in the connector housing 10 and protrude into these channels.

The electric cable 5 with the individual wires 6 is held in the circular connector 1 by means of the screw cap 13, wherein the screw cap exerts a radial force upon the cable via the sealing element 20 encompassing the cable 5 and ensures a strain-proof seal against environmental influences.

During the installation of the electric cable 5 in the circular connector, the sheath of the cable is initially stripped off by a certain length in order to separate the individual wires 6 after the screw cap 13 and the sliding ring 45 were pushed onto the electric cable 5. In this case, the braided shield 7 encompassing the individual wires underneath the sheath is simultaneously exposed.

The individual wires 6 are then inserted into the through-opening 24 of the sealing element 20, and the braided shield is twisted together on opposite sides and inserted into at least one of the slots 22 provided.

The electrically conductive sliding ring 45 according to FIG. 2*c* is then pushed onto the tube 21 of the sealing element until it reaches the twisted ends of the braided shield that lie on the collar 25. Consequently, the electrically conductive screw cap 13 to be subsequently screwed on the plug tube 11 is contacted with the sliding ring 45 and with the braided shield, respectively.

Due to the contact of the braided shield 7 with the electrically conductive screw cap 13, the shielding potential is transmitted to the outwardly pointing spring bow 32 of the shield transfer element 30. From there, the shielding potential is additionally transmitted to the neutral wire of the circular connector via the transfer contact 33.

In one variation, the braided shield 7 may also be inserted into a channel in the splicing part 40 in a twisted fashion in order to be directly contacted with the insulation displacement connector 31 of the shield transfer element.

In another variation, a so-called sheath wire embedded in the braided shield 7 is inserted into a channel in the splicing part 40 in order to be contacted with the insulation displacement connector 31 of the shield transfer element 30.

The invention claimed is:

1. A circular grounding connector for connecting a multi-wire cable having a braided shield to a circular connector plug, said circular connector comprising:

a housing with a plurality of contact elements held therein, and a generally planar shield transfer element held within said housing and comprising an insulation displacement connector, a shield transfer contact and a spring bow wherein the shield transfer element is engagable in a recess in a slot-shaped opening in the housing via a clip that obliquely protrudes from the plane of the element, and the shield transfer contact is pin-shaped and is arranged offset in a different plane relative to the plane of the element, to enhance contact with a neutral wire of the circular connector, wherein said circular connector has a cable connection side and a connector plug side and said shield transfer element transmits a shielding potential of said braided shield to the neutral wire of said connector plug.

2. The circular connector according to claim 1, wherein a sheath wire embedded in the braided shield is connected to the insulation displacement connector of the shield transfer element.

3. The circular connector according to claim 1, wherein a braided shield is connected to the insulation displacement connector of the shield transfer element.

4. The circular connector according to claim 1, further including a sealing element for holding an electric cable to the circular connector, wherein at least one slot is provided in said sealing element.

5. The circular connector according to claim 1, further including an axially arranged socket contact in the connector plug, which socket contact has a tube-like or pin-like geometry on the plug side for connection to a mating connector.

6. The circular connector according to claim 1, wherein the braided shield is in contact with an electrically conductive sliding ring that adjoins a screw cap that is connected to the plug, in which the shield transfer element is arranged in the connector housing, and wherein the plug contacts the spring bow of the shield transfer element.

* * * * *

UNITED STATES PATENT AND TRADEMARK OFFICE

CERTIFICATE OF CORRECTION

PATENT NO. : 7,255,591 B2
APPLICATION NO. : 10/973880
DATED : August 14, 2007
INVENTOR(S) : Schreier It is certified that error appears in the above-identified patent and that said Letters Patent is hereby corrected as shown below:

The following references must be added to the references cited section:

6,716,041 4/2004 Ferderer et al. 439/95
DE 102 16 483 4/2002
DE 1 813 165 6/1960
DE 32 01 142 1/1982

Signed and Sealed this

Twenty-ninth Day of September, 2009

David J. Kappos

David J. Kappos
*Director of the United States Patent and Trademark Office*